US011349585B1

(12) United States Patent
Muller et al.

(10) Patent No.: US 11,349,585 B1
(45) Date of Patent: May 31, 2022

(54) PROVISION OF RECOMMENDATIONS TO ADJUST THE ADVERTISEMENT CAMPAIGN BASED ON REAL-TIME GENERATION OF A CAMPAIGN OUTCOME INDEX

(71) Applicant: ISPOT.TV, INC., Bellevue, WA (US)

(72) Inventors: Sean Muller, Bellevue, WA (US); Stuart Schwartzapfel, New York, NY (US); Kachuen Sam Hui, Houston, TX (US); Jason Harrington, Bellevue, WA (US); John McCloskey, Woodinville, WA (US); Joseph Samuel Marcus, New York, NY (US)

(73) Assignee: ISPOT.TV, INC., Bellevue, WA (US)

( * ) Notice: Subject to any disclaimer, the term of this patent is extended or adjusted under 35 U.S.C. 154(b) by 0 days.

(21) Appl. No.: 17/158,971

(22) Filed: Jan. 26, 2021

(51) Int. Cl.

| | |
|---|---|
| ***H04H 60/32*** | (2008.01) |
| ***H04H 60/63*** | (2008.01) |
| ***H04H 60/64*** | (2008.01) |
| ***H04H 60/37*** | (2008.01) |
| ***H04H 60/31*** | (2008.01) |

(52) U.S. Cl.
CPC ..... *H04H 60/63* (2013.01); *H04H 60/31* (2013.01); *H04H 60/375* (2013.01); *H04H 60/64* (2013.01)

(58) Field of Classification Search
CPC ..... G06Q 30/00; G06Q 30/02
USPC ..... 705/14.4, 14.42, 14.71
See application file for complete search history.

(56) References Cited

U.S. PATENT DOCUMENTS

2007/0060099 A1* 3/2007 Ramer ..... G06F 16/9535 455/405
2013/0066725 A1* 3/2013 Umeda ..... G06Q 30/0275 705/14.66

* cited by examiner

*Primary Examiner* — Jivka A Rabovianski
(74) *Attorney, Agent, or Firm* — Schwabe, Williamson & Wyatt, P.C.

(57) ABSTRACT

Apparatuses, methods, and storage media for providing recommendations for an advertisement campaign are described. In one instance, an apparatus for providing recommendations for an advertisement campaign may include a campaign outcome index provision engine communicatively coupled to one or more processors, to generate a campaign outcome index (COI) associated with the advertisement campaign, based at least in part on a ratio between an actual outcome key performance indicator (KPI) associated with the advertisement campaign; and a baseline outcome KPI that reflects an expected average performance of the advertisement campaign; and a recommendation engine, communicatively coupled to the one or more processors, to provide recommendations to adjust a use of advertisements in the advertisement campaign, during the advertisement campaign, based at least in part on the generated COI. Other embodiments may be described and claimed.

17 Claims, 12 Drawing Sheets

PROVISION OF RECOMMENDATIONS TO ADJUST THE ADVERTISEMENT CAMPAIGN BASED ON REAL-TIME GENERATION OF A CAMPAIGN OUTCOME INDEX

TECHNICAL FIELD

The present disclosure relates to the field of content provision by broadcasting media, and in particular, to measuring an effect of a television advertisement rendered by the broadcasting media.

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

Traditional systems of real-time content provision, such as broadcast television (TV) of live sports, concerts, shows, films, and news, provide content that may include commercials, or advertisements. Such advertisements may be provided for rendering by e.g., product manufacturers or merchants, such as or product or service sales entities, in order to bring the users' attention to a particular product or service. Increasingly, television advertisements have been designed to work together with digital media. For example, a television advertisement may advertise a product and note that a user may learn more about that product by visiting a particular web site or downloading an application. The television advertisement can also serve to offer viewers special deals via digital media.

Accordingly, advertisement providers (e.g., business owners ("brands"), product manufacturers or service providers, hereinafter "advertisers") may be interested to have an ability to measure the impact of an advertisement, such as assess how a viewed advertisement may drive users to corresponding digital media platforms. The advertisers may be also interested in getting informed advice about how their advertisement campaigns may be improved and made more efficient.

In the current television advertising market, advertisers and TV networks typically negotiate advertising arrangements (e.g., agreements, contracts, and the like) based on volume-based metrics such as impressions, gross rating points (GRPs), or target rating points (TRPs). Because certain advertisement impressions are of "higher quality" than others (e.g., certain daypart, certain shows, pod positions, etc.), negotiations between advertisers (buyers) and networks (sellers) often have to resort to specifying minute details about the volume of impressions on specific dayparts, shows, etc.

Arrangements that are based on volume-only metrics (which guarantees only the "input", but not the advertisement campaign performance) are not the ideal solution. From the advertiser's perspective, even after specifying these quotas on the "input", the outcome performance (e.g., conversion rate, lift) that the advertiser (buyer) would get from the advertisement campaign is not guaranteed. From the network's (seller's) perspective, having all these different specifications on various types of impressions create significant logistical and scheduling challenges, which, combined with the inherent uncertainty around TV program ratings, frequently result in the need to "make-good" for shortage across different types of impressions and/or TRPs.

The relatively recent developments of outcome-based guarantee arrangements (e.g., contracts) attempt to solve the coordination problem. For example, in an outcome-based guarantee contract, buyers and sellers base their negotiations direct on an outcome measure (e.g., number of conversions/number of store visits). In this way, buyers are directly guaranteed the outcome that they care about (e.g., in terms of conversion rates), while sellers are given a single specific metric (e.g., conversion rate) to monitor and have more freedom on how to allocate impressions across different daypart/shows/positions to fulfil such guarantee.

However, adoption of the outcome-based guarantee concept has been relatively slow as there are a number of unsolved practical problems in the marketplace. First, the TV advertisement market is a mature market with a long history and ingrained conventions. Advertisers (brands) and networks (sellers) have long tradition of signing contracts based on volume-based metrics such as TRPs, and generally feel that they are not ready to move to an outcome-based contract model.

Second, advertisers and networks do not yet have a standard metric to dynamically track the ongoing performance of an advertisement campaign and to adjust performance of the campaign based on the performance. Such tracking is needed in order to perform in-flight optimization of the advertisement campaign.

Third, television networks are generally unwilling to absorb all the risk that is associated with creative quality, which affects the ad campaign's performance. Further, this risk remains outside of the network's control. Finally, there is a general lack of understanding and/or experience in the marketplace regarding how to price an outcome-based contract in reasonable manner. In summary, existing advertisement effectiveness measurement solutions may provide inadequate and sometimes inaccurate results.

BRIEF DESCRIPTION OF THE DRAWINGS

Embodiments will be readily understood by the following detailed description in conjunction with the accompanying drawings. Embodiments are illustrated by way of example, and not by way of limitation, in the figures of the accompanying drawings.

DETAILED DESCRIPTION

Figure 1:
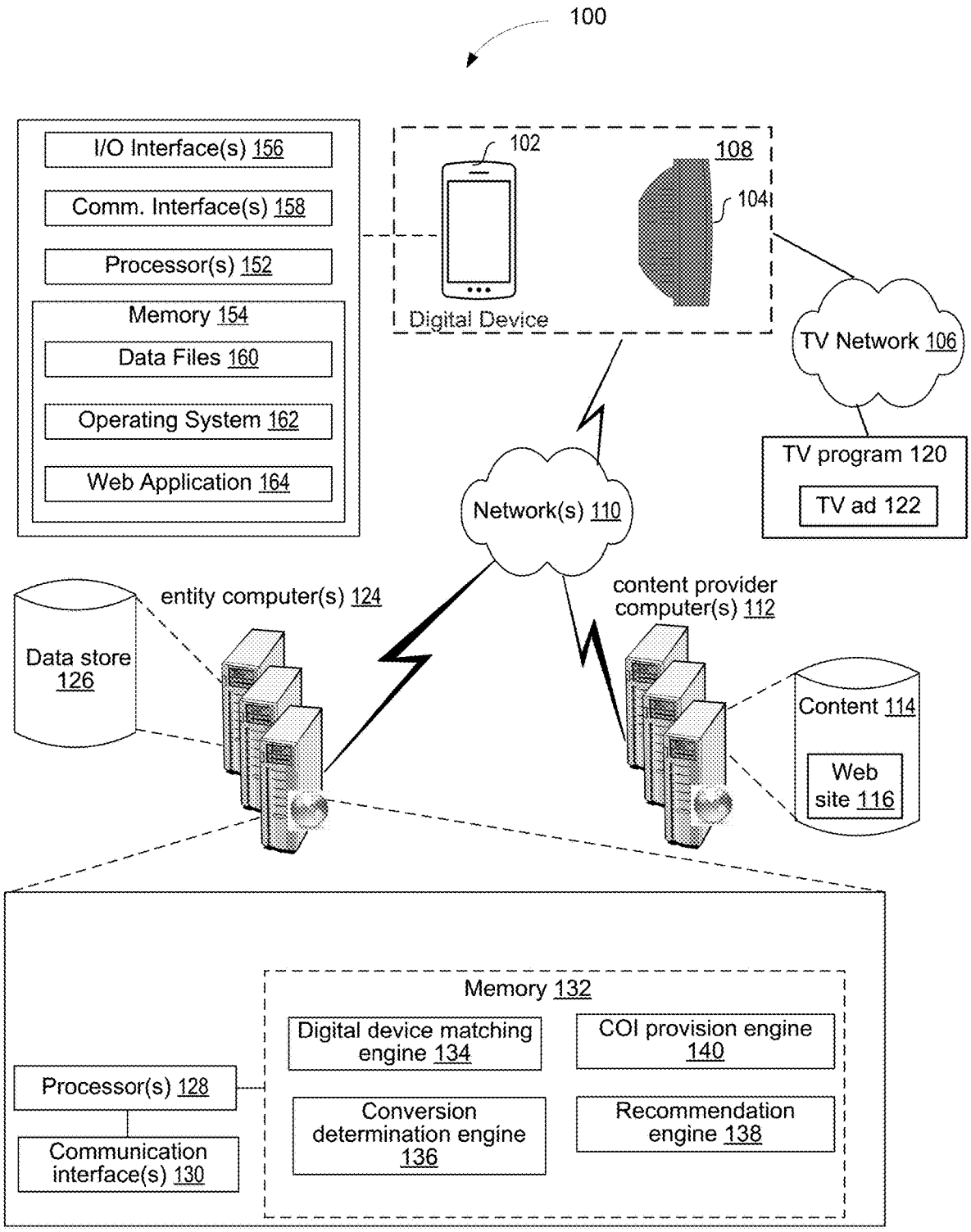
FIG. 1 is a block diagram illustrating an example computing environment for advertisement performance measurement and advertisement campaign adjustment, based on the measured performance, in accordance with some embodiments.

Embodiments of the present disclosure describe techniques and configurations for providing recommendations for an advertisement campaign, in accordance with some embodiments. In some embodiments, an apparatus for providing recommendations for an advertisement campaign for may include one or more processors. The apparatus may further include a campaign outcome index provision engine communicatively coupled to one or more processors, to generate a campaign outcome index (COI) associated with the advertisement campaign, based at least in part on a ratio between an actual outcome key performance indicator (KPI) associated with the advertisement campaign. The apparatus may further include a baseline outcome KPI that reflects an expected average performance of the advertisement campaign; and a recommendation engine, communicatively coupled to the one or more processors, to provide recommendations to adjust a use of advertisements in the advertisement campaign, during the advertisement campaign, based at least in part on the generated COI.

In embodiments, an actual outcome KPI may comprise a conversion rate or other performance-reflecting parameters. A baseline outcome KPI that reflects the expected average performance of an advertisement campaign with defined characteristics. In embodiments, the COI for an advertisement campaign is dynamically computed and updated continually throughout the advertisement campaign, which allows networks to track a campaign's performance and perform in-flight real time adjustments as needed. In embodiments, an extension of the outcome-based performance parameter, capped index, can be identified. The capped index may allow networks to effectively control the risk characteristics of outcome-based guarantee contract performance.

In the following detailed description, reference is made to the accompanying drawings that form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), (A) or (B), or (A and B). For the purposes of the present disclosure, the phrase "A, B, and/or C" means (A), (B), (C), (A and B), (A and C), (B and C), or (A, B, and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

As used herein, the terms "logic" and "module" may refer to, be part of, or include an application specific integrated circuit (ASIC), an electronic circuit, a processor (shared, dedicated, or group), and/or memory (shared, dedicated, or group) that execute one or more software or firmware programs, a combinational logic circuit, and/or other suitable components that provide the described functionality.

FIG. 1 is a block diagram illustrating an example computing environment for advertisement performance measurement and advertisement campaign adjustment, based on the measured performance, in accordance with some embodiments.

The environment 100 may include one or more electronic digital devices 102. The digital device 102 may include any appropriate device operable to send and receive requests, messages, or information over an appropriate network 110 and convey information back to a user of the digital device 102. Examples of such digital devices may include personal computers, smartphones, laptop computers, set-top boxes, tablet computers, and the like. The digital device 102 may include a processor 152 and memory 154 for storing processor-executable instructions, such as data files 160, operating system 162, and one or more web applications 164 allowing the users to interact with network resources, such as, for example, social networking web sites or a web site of a merchant. The digital device 102 may further include at least one or more of the following elements: input/output interface (e.g., a display or a screen) 156 and communication interface 158.

The environment 100 may further include a TV set 104, which may render TV programs (e.g., shows and the like) and TV advertisements for viewing by the user. The TV programs, including TV advertisements may be provided by broadcasting entities via TV network 106. In embodiments, the digital device 102 and 104 may be associated with a particular user, e.g., may belong to a user, and may be disposed at a shared location 108, for example, a user's residence, place of work, or the like. TV network 106 may commonly, though not exclusively, distribute linear television content through operators, such as through cable companies. TV network 106 may distribute linear television content directly through certain types of TV distribution media, such as through terrestrial broadcast media. Television content distributed for rendering on TV set 104 may include, for example, programs 120, such as shows, films, sport and music events, etc. The programs 120 may include one or more TV advertisements 122 provided by advertisers for rendering with the programs.

The network 110 may be any appropriate type of network, including an intranet, the Internet, a cellular network, a local area network, or any other such network or combination thereof. Protocols and components for communicating via such a network are well known and will not be discussed herein in detail. Communication over the network may be enabled by wired or wireless connections, and combinations thereof. In embodiments, the network 110 may include the Internet, and the environment 100 may include one or more computing devices, such as content provider servers 112 for receiving requests and serving content 114 in response thereto. The content 114 served by the content provider servers 112 may include network resources, such as merchant web site 116 accessible by the users of the digital device 102. The web site 116 may host information about (e.g., a catalog of) items (products services, or the like) offered by the merchant for viewing and purchase.

A merchant may be an entity that facilitates a provision of content (e.g., items for purchase stored in the catalog) to an associated network resource (e.g., web site 116). The items for purchase may be provided by the merchant and/or by third parties that may or may not be associated with the merchant. The merchant or a third party associated with the merchant may be an advertiser, e.g., it may provide a TV advertisement (or advertisements) 122 describing a product or service, for rendering with the program 120.

The illustrative environment 100 may include one or more computing devices 124 associated with an advertisement effectiveness measurement entity, e.g., a business entity that provides the measurement of effectiveness of an advertisement campaign, and recommendations regarding effectiveness of advertisement campaign performance, such as provision of dynamic ("in-flight") optimization of the advertisement campaign, based on the measured effectiveness. In embodiments, the computing device 124 (e.g., a server or a cluster of servers) may be associated with (e.g., have access to) a data store 126. The data store 126 may store content provided by a merchant-associated entity, e.g., web site 116, and/or user devices, such as digital device 102 and/or TV set 104.

The content may include data (e.g., user-associated data, viewing data, or the like) that may be used for the measurement of effectiveness of TV advertisements. The user-associated data may include, for example, the date and time of the user access of the web site 116 via the digital device 102, an internet protocol (IP) address associated with the digital device 102, a web site 116 identifier, a user identifier associated with the web site 116, a uniform resource locator (URL) associated with the web site 116, a type of a browser associated with access to the web site 116 (e.g., the browser residing on the digital device 102), a type of the digital device 102; operating system (OS) associated with the digital device 102, tracking cookies, and/or or one or more tags for reporting or filtering, supplied by the merchant or a third party associated with the merchant.

The data may further include indication of locations of the digital device 102 and TV set 104. For example, the data may indicate that the digital device 102 and TV set 104 share the common location 108.

The data may further include viewing data. For example, TV set 104 may report back to a data collection entity (e.g., computing device 124) the content being watched by the user. The data collection entity may utilize an advertisement video catalog (e.g., internally generated catalog) to detect, e.g., using video fingerprinting, when devices (e.g., digital device 102 and/or TV set 104) are rendering for display specific commercials. The data collection entity may generate a log of the viewing data (e.g., TV set 104 viewing data). The log may include the date/time of the event, user's IP address, a unique TV device ID, and the advertisement that was viewed. This data may be used to determine when a TV device and a digital device share the same location (IP) at generally the same time to determine a TV device ID associated with the user, which may then be used to determine historical viewing data.

The data may further include one or more conversion actions (events) associated with the user and executed on the digital device 102. In embodiments, the conversion actions may include user activities resulting from viewing the TV advertisement 122 on the TV set 104. For example, the user viewed a TV advertisement about one or more items (e.g., products or services). In embodiments, the conversion actions resulting from viewing the TV advertisement may include one or more of: using the digital device 102, accessing a web site that hosts information about the items; viewing information about the item; selecting one or more of the viewed items; adding the selected items to cart, checking out the selected items, and the like.

In general, the user-associated data may include any user identity indicators that may be provided by a web site visited by the user via her digital device, and/or user identity indicators that may be provided by the digital device associated with the user.

The computing device 124 may include, or associate with, one or more processors 128 that may be connected to a communication interface 130 and memory 132. In embodiments, the memory 132 may include (e.g., store) a digital device matching engine 134, communicatively coupled to, and executable on, the processors 128, to process one or more user identity indicators received from a web site (e.g., 116) accessed by a digital device (102). The digital device matching engine 134, when executed on the processors 128, may be configured to match the digital device 102 to a TV set (e.g., 104). The matching may be provided based at least in part on the user-associated data, such as one or more identity indicators listed above.

The memory 132 may further include a conversion determination engine 136, communicatively coupled to, and executable on the processors 128. In embodiments, the conversion determination engine 136 may be configured to determine a level of conversion (e.g., conversion rate) associated with an advertisement (e.g., 122) rendered by a broadcasting media to the TV set 104, based at least in part on the matching of the digital device 102 to the TV set 104, provided by the digital device matching engine 134. As noted, conversion may define user actions on the web site in response to viewing the advertisement on the TV set. An example conversion determination technique is described in reference to FIG. 2.

The memory 132 may further include a COI provision engine 140 communicatively coupled to, and executable on the processors 128. In embodiments, the COI provision engine 140 may be configured to determine, in real or near-real time, a campaign outcome index, and provide the determined COI for in-flight optimization recommendations regarding the advertisement campaign. The determination of the COI according to some embodiments is described below.

In embodiments, the COI is a metric provided to reflect the relative performance of an advertisement campaign vis-à-vis other comparable campaigns, by comparing the actual performance of the current campaign versus the baseline performance that is to be expected given the campaigns characteristics. For example, performance can be measured using any outcome KPI, which may include, but is not limited to, conversion rate, lift, store visit, web visits/purchases, attention, etc. In embodiments, COI may be defined as:

COI=Actual Outcome KPI/Baseline Outcome KPI

If the advertisement campaign outperforms the baseline outcome, the CPI may be above 1.0. If COI is below 1.0, this would indicate advertisement campaign underperformance relative to the baseline. In embodiments, the "baseline" outcome KPI may reflect the "average" performance that is to be expected of an advertisement campaign with similar characteristics as the current advertisement campaign. After an advertiser specifies the characteristics of an advertisement campaign (e.g., a number of TRPs, advertisement airing duration and their proportions (e.g., 15 s/30 s), dayparts), the "baseline" outcome KPI can be identified, utilizing a procedure that analyzes historical data. The details of such procedure are discussed in reference to FIGS. 2-3.

As a general concept, the network may be "rewarded" if the COI is above 1.0, which indicates better-than-baseline outcome performance for the advertisers, presumably because the network has provided higher-than-average quality advertising placement (e.g., better daypart, better "match" between advertisement and program, less pod clutter, and the like). On the other hand, the network may be "penalized" if the COI is below 1.0, which indicates worse-than-baseline outcome performance for the advertiser, presumably due to inferior advertising placement (e.g., inferior pod positions) than average. For example, an outcome-based agreement between the network and the advertiser that utilizes the COI as a modified indicator of the advertisement campaign performance may provide the reward and penalty structure, thus resulting in better alignment between the network and the advertiser.

The memory 132 may further include a recommendation engine 138, communicatively coupled to, and executable on the processors 128. In embodiments, the recommendation engine 138 may be configured to provide recommendations to optimize the advertisement campaign (in-flight optimization), as described in greater detail in reference to FIG. 9.

While the digital device matching engine 134, conversion determination engine 136, COI provision engine 140, and recommendation engine 138 are described herein as software residing in memory 132, other implementations are possible. For example, the digital device matching engine 134, conversion determination engine 136, and recommendation engine 138 may be implemented as software, hardware, firmware, or any combinations thereof.

The environment 100, in some embodiments, may be a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are illustrated in FIG. 1. Thus, the depiction of the system 100 in FIG. 1 should be taken as being illustrative in nature, and not limited to the scope of the disclosure.

Figure 2:
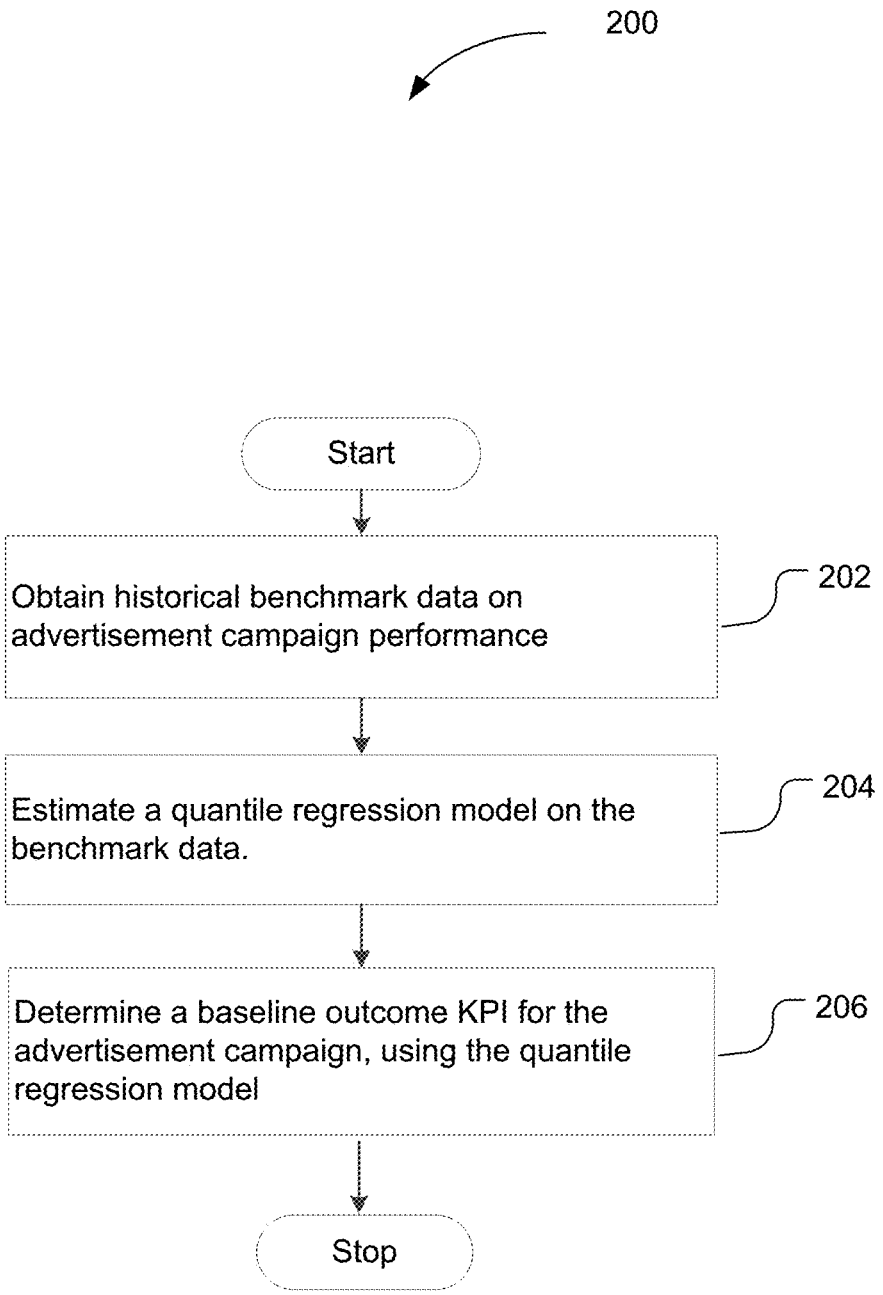
FIG. 2 illustrates an example process for determining a baseline performance of an advertisement campaign, in the environment of FIG. 1, in accordance with some embodiments.

FIG. 2 illustrates an example process for determining a baseline performance of an advertisement campaign, in the environment of FIG. 1, in accordance with some embodiments. The process 200 may be performed, for example, by the computing device 124 configured with the digital device matching engine 134, conversion determination engine 136, COI provision engine 140, and recommendation engine 138 described in reference to FIG. 1. It should be understood that the actions described in reference to FIG. 2 may not necessarily occur in the described sequence. Some actions may take place substantially concurrently with other actions described in reference to FIG. 2.

The process 200 begins at block 202, and includes obtaining historical benchmark data on advertisement campaign performance. For example, the computing device 124 may pull from associated servers 124 all advertisement airing data (e.g., for a period of time, such as, for example, for the past 2 years) for the advertiser entity on a particular network, and record the outcome KPI (e.g., conversion rate), along with other advertisement campaign characteristics. Other examples of benchmark data may include, but are not limited to, historical "lift" data of other comparable campaigns in the past, demographics-specific (e.g., age 18-34 male) conversion rate of other campaign, or the attention score that is obtained by other advertising campaign in the past. More generally, benchmark data may include any pertinent outcome information about advertising campaigns.

At block 204, the process 200 includes estimating a quantile regression model based on the benchmark data. The regression model serves to statistically adjust for the effect of campaign covariates (e.g., proportion of 15 s/30 s ads, seasonality, proportion of different dayparts, and the like). An example estimation of the regression model is provided in reference to FIG. 3.

Figure 3:
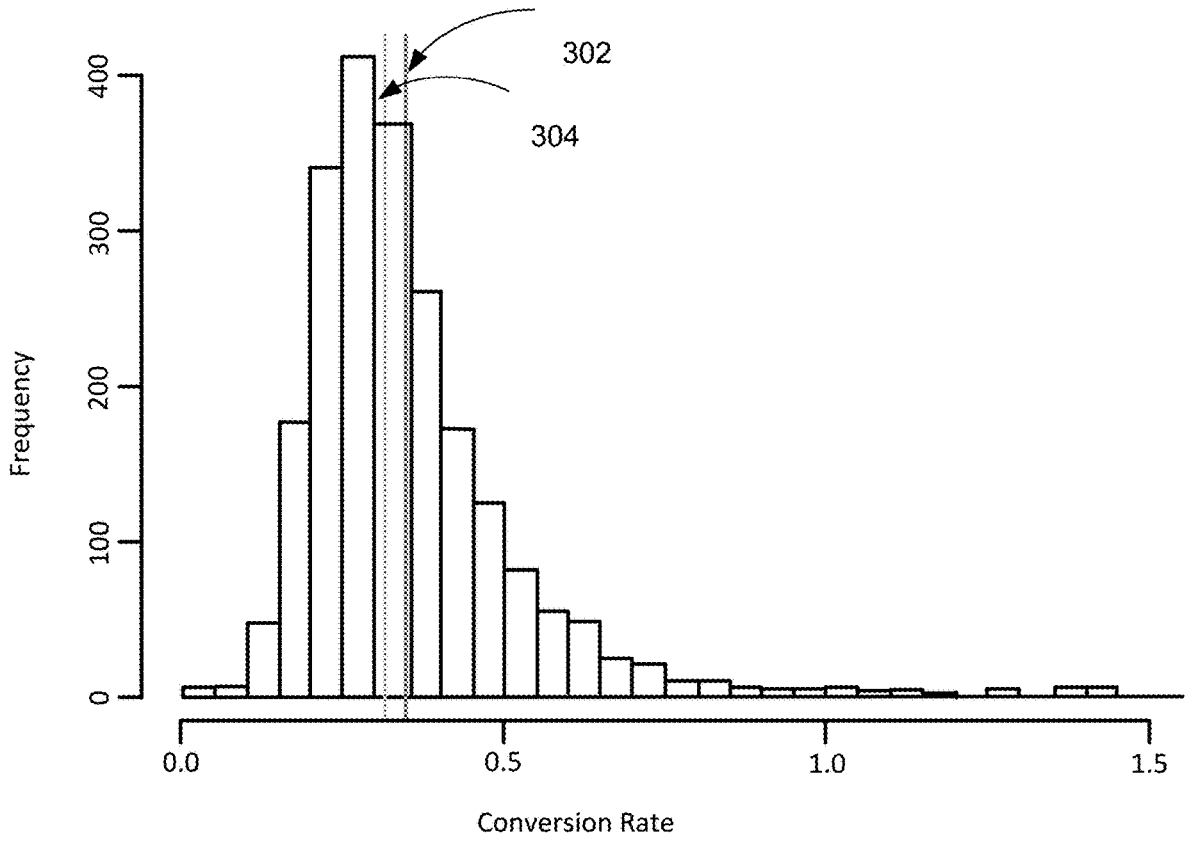
FIG. 3 illustrates an example histogram of an outcome KPI as a function of a frequency of impression airings in accordance with some embodiments.

FIG. 3 illustrates an example histogram of an outcome KPI as a function of a frequency of impression airings in accordance with some embodiments. In this example, the KPI comprises a conversion rate. However, any other characteristic of the advertisement campaign performance can be utilized herein, In the provided example histogram of FIG. 3, the conversion rate exhibits a degree of skewness. As a result, the median 302 is a better representation of the baseline performance than the mean 304. This is a common pattern among many different KPIs across many different brands and networks. Thus, a median regression (which is a statistical procedure that is robust to skewed distributions) can be estimated on the data to provide the conversion rates with given campaign characteristics. The results from the median regression show that, for the example data shown in FIG. 3, the conditional conversion rate for 15 s advertisements and 30 s are 0.305% and 0.324%, respectively.

Returning to process 200, at block 206, the process 200 includes determining a baseline outcome KPI for the advertisement campaign, using the quantile regression model. For example, the above estimates can be combined to determine the baseline conversion rate for the advertisement campaign. In the example of FIG. 3, given that the campaign may have a 50-50% mix of 15 s and 30 s ads, the campaign level baseline conversion rate is 0.5*0.305%+0.5*0.324%=0.314%.

Figure 4:
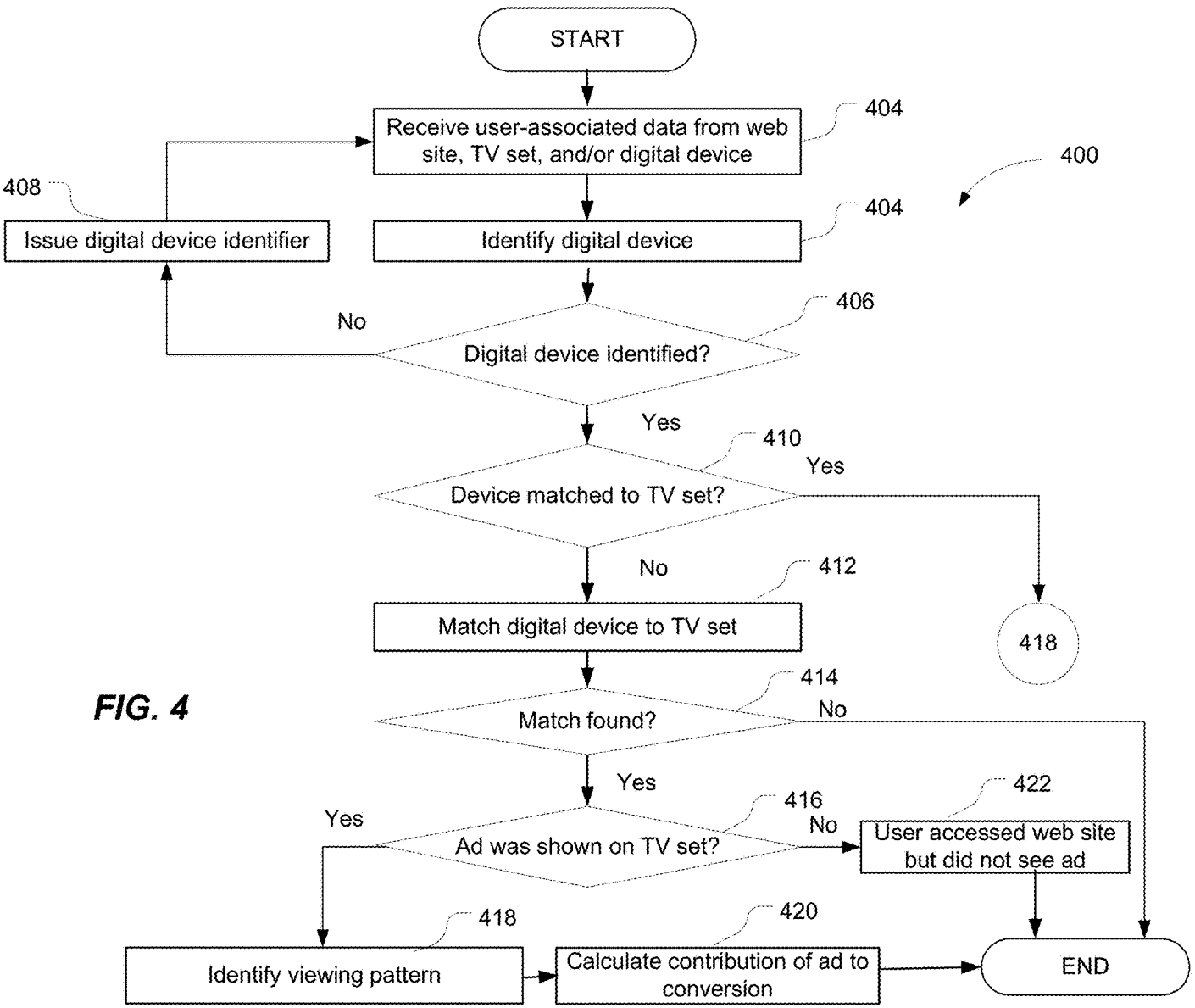
FIG. 4 illustrates an example process for advertisement performance measurement, in the environment of FIG. 1, in accordance with some embodiments.
Figure 5:
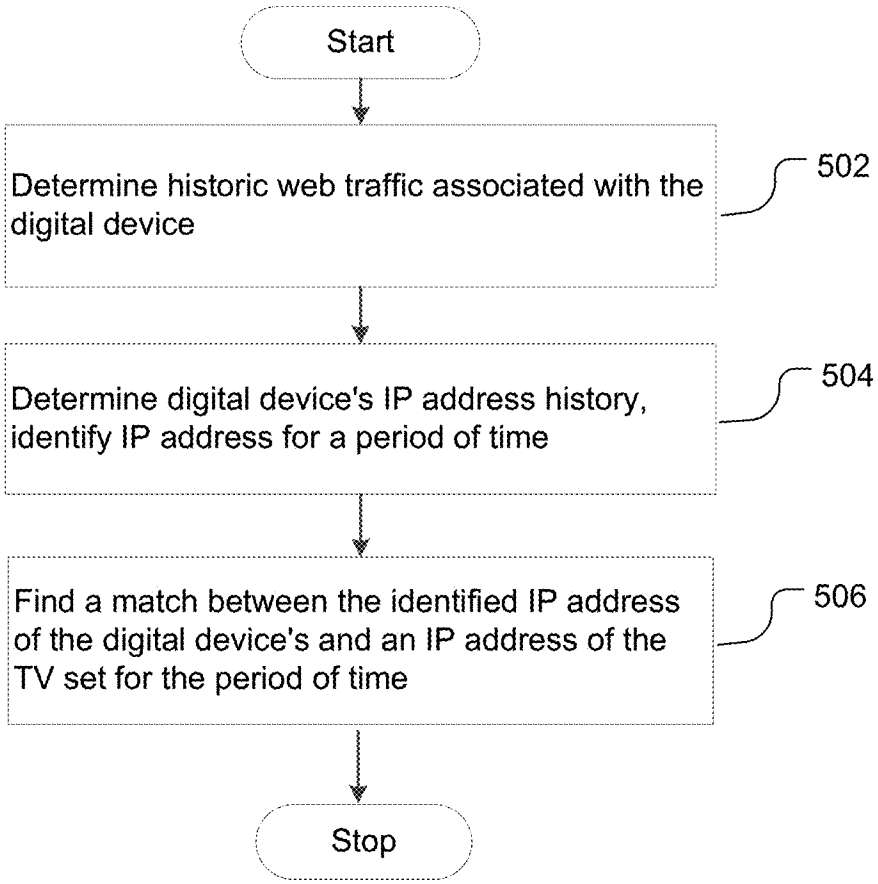
FIG. 5 illustrates an example process for matching a digital device to a TV set in the environment of FIG. 1, in accordance with some embodiments.

In embodiments, during an advertisement campaign, an actual outcome KPI may be determined, using example advertisement performance measurement techniques described in reference to FIGS. 4-5.

FIG. 4 illustrates an example process for advertisement performance measurement, in the environment of FIG. 1, in accordance with some embodiments. Specifically, process 400 may be used to provide an actual outcome KPI. The process 400 may be performed, for example, by the computing device 124 configured with the digital device matching engine 134, conversion determination engine 136, COI provision engine 140, and recommendation engine 138 described in reference to FIG. 1. It should be understood that the actions described in reference to FIG. 4 may not necessarily occur in the described sequence. Some actions may take place substantially concurrently with other actions described in reference to FIG. 4.

The process 200 begins at block 402, and includes receiving user-associated data from a web site (116), TV set (104) and/or digital device (102). As described above, the data may be used for the measurement of effectiveness of TV advertisements and may include, for example, the date and time of the user access of the web site 116 via the digital device 102, an IP address associated with the digital device 102, a web site 116 identifier, a user identifier associated with the web site 116, a URL associated with the web site 116, a type of the browser residing on the digital device 102, a type of the digital device 102; OS associated with the digital device 102, tracking cookies, tags for reporting or filtering, conversion data, and location information.

At block 404, the process 400 may include identifying a digital device associated with the user. The digital device identification may be provided base on the information listed above. The digital device identification may include associating a device with a user, determining a type of the digital device, or the like. The digital device identification may include recognizing a unique identifier issued to and associated with the device. The digital device identifier may be issued by the advertisement effectiveness measurement entity and provided by the computing device 124.

At decision block 406, the process 400 may include determining whether the digital device was identified. If the digital device was not identified, the process 400 may move to block 408, where a digital device identifier may be issued and associated with the digital device. As noted, the digital device identifier may be issued by the advertisement effectiveness measurement entity and provided by the computing device 124 to the digital device 102.

If the digital device was identified, the process 400 may move to decision block 410. At decision block 410, the process 400 may include determining whether the digital device is matched to the TV set. The matching may include associating the digital device with the TV set based on, for example, common location, user identity, IP address history, or the like. In some embodiments, a match may be determined based on identifying a user and recalling a TV set to which the user may have been matched previously.

If the digital device is matched to the TV set, the process 400 may move to block 418. If the digital device is not matched to the TV set, the process 200 may move to block 412, where such matching may occur. The matching process is described in greater detail in reference to FIG. 3.

At decision block 414, the process 400 may include determining whether the match was found. If the match was not found, the process 400 may end. If the match was found, the process 200 may move to decision block 416.

At decision block 416, the process 400 may include determining whether the advertisement was shown on the matched TV set. If the advertisement was not shown, the process 400 may move to block 422, in which a determination may be made that the user did access the web site, but did not see the advertisement, and therefore no conversion event has occurred. If the advertisement was shown, the process 400 may move to block 418.

At block 418, the process 400 may include identifying the user's viewing pattern. For example, using the TV viewing data, all relevant advertisement airings this user may have been exposed on TV set 104 to may be identified. The TV viewing data may be provided by the TV set 104. The viewing data may include a list of programs rendered on the TV set associated with the user over a period of time. As briefly described above, a data feed of TV set viewing data may be available from the TV set. Once a match to a TV set is completed, a corresponding viewing history and IP address-related history may become available.

At block 420, the process 400 may include calculating contribution of the advertisement to the conversion. The conversion contribution calculation process will be described in greater detail in reference to FIG. 6. The contribution of the advertisement to the conversion may serve as a measurement of the advertisement effectiveness.

FIG. 5 illustrates an example process for matching a digital device to a TV set in the environment of FIG. 1, in accordance with some embodiments. The process 500 provides a description of actions described in reference to block 412 of FIG. 4.

The process 500 may begin at block 502 and include determining historic (e.g., previous) web traffic associated with the digital device. The digital device may have been identified earlier in the process of FIG. 4. Such determination may be performed using, for example, a tracking unique identifier assigned to the digital device by the merchant or by the advertisement effectiveness measurement entity, as described in reference to block 408 of FIG. 4.

At block 504, the process 500 may include determining digital device's IP address history, based on the determined web traffic. For example, the digital device's IP address history may be captured along with associated web traffic. Based on the IP address history, it may be possible to identify an IP address of the digital device during a particular time period. The time period may be, e.g., a particular week, day, or other time period of interest, such as the time period during which the merchant's advertisement was rendered on the TV set of the user.

At block 506, the process 500 may include finding a match between the identified IP address of the digital device's and an IP address of the TV set, for example, for the same time period (e.g., time period of interest). The matching may be performed using, for example, the viewing data associated with the TV set. For example, a device activity at the same IP address as the TV set may be identified and the matching may be based on this information. More specifically, viewing data may contain date/time and IP address for every event reported, and the IP history of the digital device and TV set may be compared, in order to produce a match. For example, IP address history from the digital device (from tracked web traffic) may be compared to IP address history from the TV set (e.g., through activity data supplied by a third party, e.g., the data partner, or by the business entity) to look for devices and TVs that occupied the same IP at the same time, meaning they are both at the same physical location.

Figure 6:
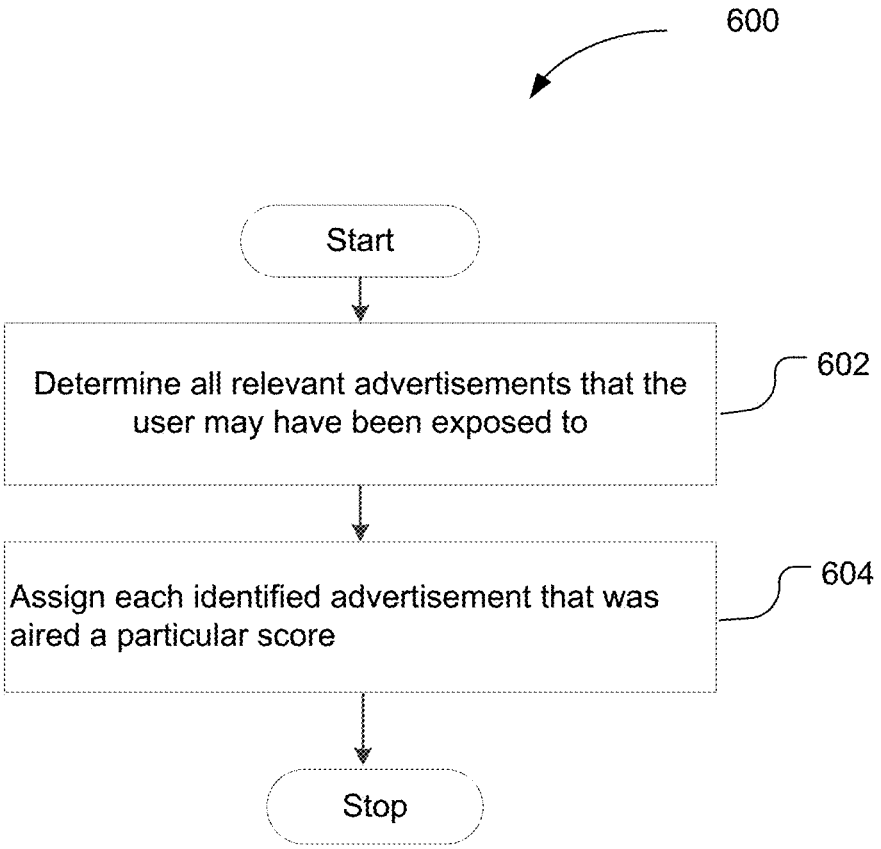
FIG. 6 illustrates an example process for measuring contribution of an advertisement to conversion in the environment of FIG. 1, in accordance with some embodiments.

FIG. 6 illustrates an example process for measuring contribution of an advertisement to conversion in the environment of FIG. 1, in accordance with some embodiments. The process 600 illustrates a detailed description of actions described in reference to block 420 of FIG. 4.

The process 600 may begin at block 602 and include determine all relevant advertisements that the user may have been exposed to. Such determination may be performed, for example, using the TV viewing data associated with the user (see block 418 of FIG. 4).

At block 604, the process 600 may include assigning each identified advertisement that was aired a particular score, e.g., a fraction of the credit for the conversion that followed, with all scores adding up to 100%. Different attribution models may apply credit differently. For example, all advertisements may be assigned equal credit, most recent advertisement may get most credit, the assigned scores may decay for older advertisement, and the like. For example, a user who performed a conversion event viewed four impressions of an advertiser's TV ads on various channels at different times. Using an equal weighting attribution model, the contribution each advertisement made to the conversion may be scored as follows: Impression A: 25%, Impression B: 25%, Impression C: 25%, Impression D: 25%.

In another example, a user who performed a conversion event viewed two impressions of an advertiser's TV advertisements: impression A on the day of the conversion, and impression B seven days previous. Using a time decay attribution model, the contribution each advertisement made to the conversion may be scored as follows: Impression A: 67%, Impression B: 33%.

Accordingly, at block 604, the process 600 may include applying an attribution model to the scored advertisements, to obtain a measurement of the contribution of the advertisements to the conversion event.

In summary, the processes described in reference to FIGS. 4-6 provide for obtaining a measurement of the contribution of the advertisements to conversion in the computing environment of FIG. 1, in order to calculate the actual outcome KPI of the advertisement campaign. As described above, the campaign outcome index COI may be determined based on the actual and baseline outcome KPIs.

In embodiments, COI determined as described above may be utilized in providing contractual agreements between advertisers and networks. Specifically, an advertiser (e.g., brand) and a seller (e.g., network) agree on an outcome-based contract with the following structure:

{Y ERP @baseline outcome KPI=Z} where ERP stands for "Effective Rating Points", which computed based on TRP (Target Rating Points), with the COI as a modifier (as will be discussed in detail below). As noted above, the baseline outcome KPI can be any number of outcome metrics of interest, e.g., conversion rate, website visit, store visits, purchases, attention, etc. Y and Z are contract parameters. For instance, a contract can be specified in the form of {10.0 ERPS @ baseline conversion rate=0.5%}. In this case Y=10.0, Z=0.5%, and outcome KPI=conversion rate. Effective Rating Points (ERP) can be computed using the following formula:

$$\text{Effective Rating Points(ERP)}=\text{COI}*\text{TRP}$$

Accordingly, ERP can be determined as:

$$\text{(ERP)}=\text{TRP}*\text{Actual Outcome KPI of the advertisement campaign/Baseline Outcome KPI of the advertisement campaign.}$$

As can be seen from the above equation, in an outcome-based contract (or other kind of agreement between the buyer (advertiser) and seller (network), hereinafter "contract" for purposes of understanding), TRPs are "scaled" by the COI. Accordingly, buyers and sellers are indirectly contracting on the outcome KPI, while operating in terms of a volume-based metric such as TRP. The term "indirect contracting" is used here in contrast to other forms of contracts or agreements that explicitly guarantee a certain outcome, rather than using ERP (which is an example of an "indirect" route). For instance, a network can sell a brand an advertising scenario that guarantees 100% conversion rate; this would be an example of a direct guarantee. Specifically, the network can guarantee that the number of conversion events would be equal to the contracted volume multiplied by the agreed-upon conversion rate.

More specifically, under an outcome-based contract as described in the above equation, providing 10.0 TRPs at 0.5% conversion rate is equivalent to providing 5.0 TRPs at 1.0% conversion rate, as both reflect the same number of conversion events.

Returning to the numerical example discussed in reference to FIGS. 2-3, an example outcome-based contract for that context will be described. Recall that the example advertisement campaign as described in reference to FIGS. 2-3 is comprised of a 50-50% mix of 15 s and 30 s ads. It is further assumed that the buyer (brand) would like to purchase 10.0 Effecting Rating Points (ERP) at the "baseline" conversion rate of 0.314% (as computed in reference to FIGS. 2-3). In this case the contract may be specified as: {10.0 Effective Rating Points, 50-50% mix of 15 s/30 s ads, at baseline conversion rate=0.314%}. Two examples described below illustrate what happens at the end of an advertisement campaign through two different scenarios as.

Example 1: At the end of the advertisement campaign, the network delivered 9.0 (raw) TRPs. The actual campaign-level conversion rate is 0.4%. In this case, COI=0.400/0.314=1.27. Effective Rating Points (ERP)=1.27*9.0=11.43. Thus, the contract is fulfilled.

Example 2: At the end of the advertisement campaign, the network delivered 11.0 (raw) TRPs. The actual campaign-level conversion rate is 0.25%. In this case, COI=0.250/0.314=0.80. Effective Rating Points (ERP)=0.80*11.0=8.8. Thus, the contract is not fulfilled. The network needs to "make up" for 10.0–8.8=1.2 ERPs by airing additional advertisement impressions.

In embodiments, the computing environment of FIG. 1 and provision of COI based on the computing environment of FIG. 1 may serve to provide recommendations to advertisers regarding potential improvements in the advertisers' advertisement practices. For example, recommendations can be made based on certain advertisements or TV networks driving more conversions. Advertisement funding can be moved to more effective networks or shows and higher performing advertisements may be run instead of lower performing advertisements. The provision of recommendations for an advertisement campaign based on a real-time COI determination is described below.

While the numerical examples described above focus on the value of COI at the conclusion of an advertisement campaign, another powerful feature of the campaign outcome index is that it can be computed and updated dynamically during the course of an advertisement campaign. This may allow a seller (network) to examine the value of the index over time and make corresponding advertisement campaign real-time ("in-flight") adjustments or perform in-flight optimization as needed. In some embodiments, the appropriate recommendations regarding campaign optimization may be made to an advertisement campaign performers (e.g., a network).

As described in reference to FIGS. 4-6, a real-time or near-real time reporting system update data on advertisement airing, impression, conversion events, and outcome metrics such as (but not limited to) conversion rates may be provided to a seller on an ongoing basis. For example, the current value of the campaign outcome index can be provided at any point in time during the advertisement campaign. An example process for provision of a COI to an advertisement campaign is depicted by the process diagram of FIG. 7.

Figure 7:
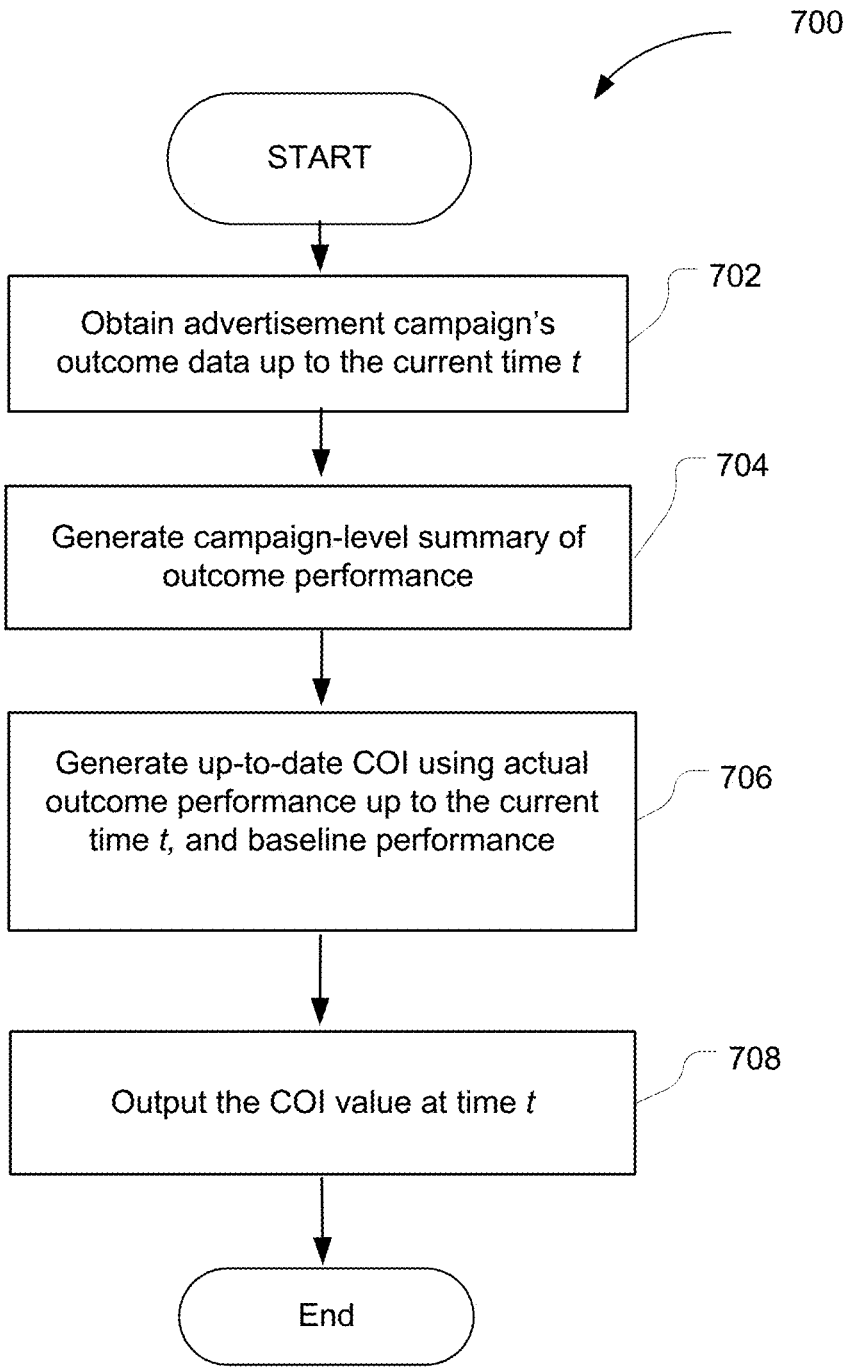
FIG. 7 illustrates an example process for a real-time provision of the campaign outcome index, in accordance with some embodiments.

FIG. 7 illustrates an example process for a real-time provision of the campaign outcome index, in accordance with some embodiments. The process 700 may be performed, for example, by the COI provision engine 140 of FIG. 1.

The process 700 begins at block 702 and may include obtaining advertisement campaign's outcome data up to the current time t. As described above, such data may be collected by, and obtained from, entity computers (servers) 124, by pulling the relevant data within a determined time window. The data may include any relevant outcome data for a certain campaign. Examples may include but are not limited to, the breakdown of conversion rate, attention index, lift by subnetworks, daypart, pod position, show genre, show subgenre, and the like.

At block 704, the process 700 may include computing campaign-level summary of outcome performance. In embodiments, such summary may be obtained based on techniques described in reference to FIGS. 4-6. The summary here is obtained up to current time t, rather than for the entire campaign. Thus, this provides networks a way to see if the continuing advertisement campaign is on target or on track to fulfil their guarantees to the buyers (brands).

At block 706, the process 700 may include generating up-to-date COI based at least in part on the actual outcome performance, such as actual outcome KPI (e.g., up to the current time t), and baseline performance (e.g., baseline outcome KPI) of the advertisement campaign. The actual performance may be generated as described in reference to FIGS. 4-6. The baseline performance may be provided as described in reference to FIGS. 2-3.

At block 708, the process 700 may include outputting the COI value at the current time t.

Accordingly, the campaign outcome index can be provided at any point in time, by pulling the relevant data within a certain time window and generating COI based on this data. This enables a seller (e.g., a network) to obtain the COI value over time during an advertising campaign. Such information can be useful for networks for planning purposes. For example, if the network observes that the value of COI has dropped below the baseline level for certain weeks, indicating that advertisement airings are now performing below their expected performance level, they may adjust advertisement placement, such as pod position or better manage pod clutter. In some embodiments, the entity providing COI (e.g., entity server 124 of FIG. 1) may provide advertisement campaign adjustment recommendations to the network, as will be described below. The real-time (in-flight) adjustment and optimization of the advertisement campaign leads to better overall conversion performance and more stable time period (e.g., week-to-week) conversion rates generated by the advertisement campaign.

Figure 8:
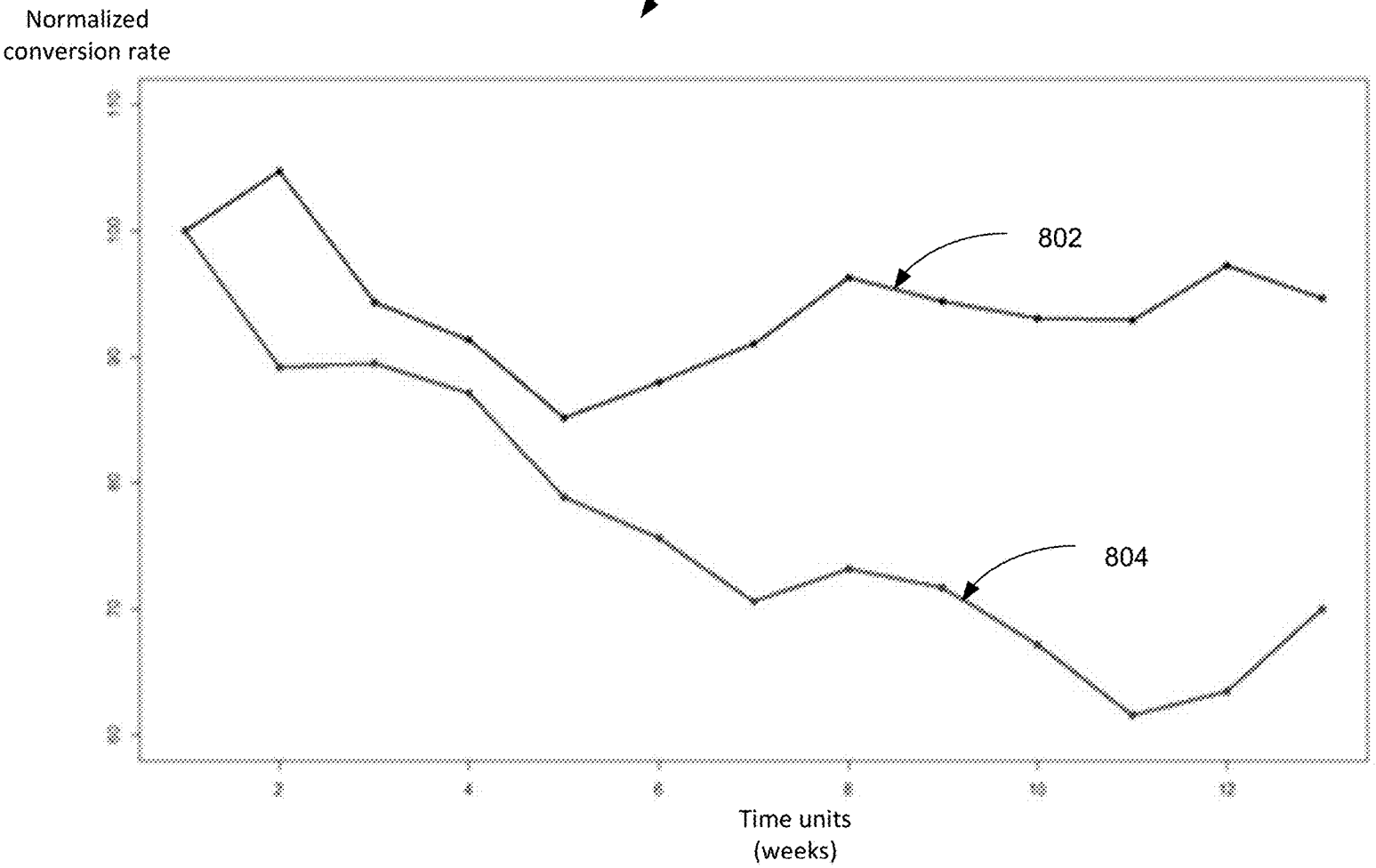
FIG. 8 is an example diagram illustrating a comparison between conversion performance of a generic advertisement campaign and an advertisement campaign that employed real-time adjustment based on provided campaign outcome index (COI) values, in accordance with some embodiments.

FIG. 8 is an example diagram illustrating a comparison between conversion performance of a generic advertisement campaign and an advertisement campaign that employed real-time adjustment based on provided COI values, in accordance with some embodiments. More specifically the graph of FIG. 4 compares the normalized time trend (week #1=100) of a major brand's advertisement campaign that includes an outcome-based guarantee (graph 802), to a benchmark time trend of a number (in this example, ten) advertisers (brands) during the same time window (graph 804), over a determined time period (in this example, 13-week period). In graph 802, y-axis is a normalized conversion rate, i.e., conversion rate scaled by a constant.

As can be seen, once the graph 802 dips below a certain point (right below the guaranteed conversion rate level, which in this example is a normalized conversion rate equals 85) the trend points up again and stabilizes. In contrast, similar campaigns that did not utilize an outcome-based guarantees continue to drift down, as shown by graph 804. This provides evidence for the value of outcome-based guarantee in stabilizing outcome performance through in-flight optimization.

In embodiments, recommendations regarding campaign adjustment based on the real-time obtained COI values may be provided to the network during the advertisement campaign. For example, entity computers (servers) 124 may provide further analysis and corresponding recommendations to TV network 106, referencing FIG. 1.

Figure 9:
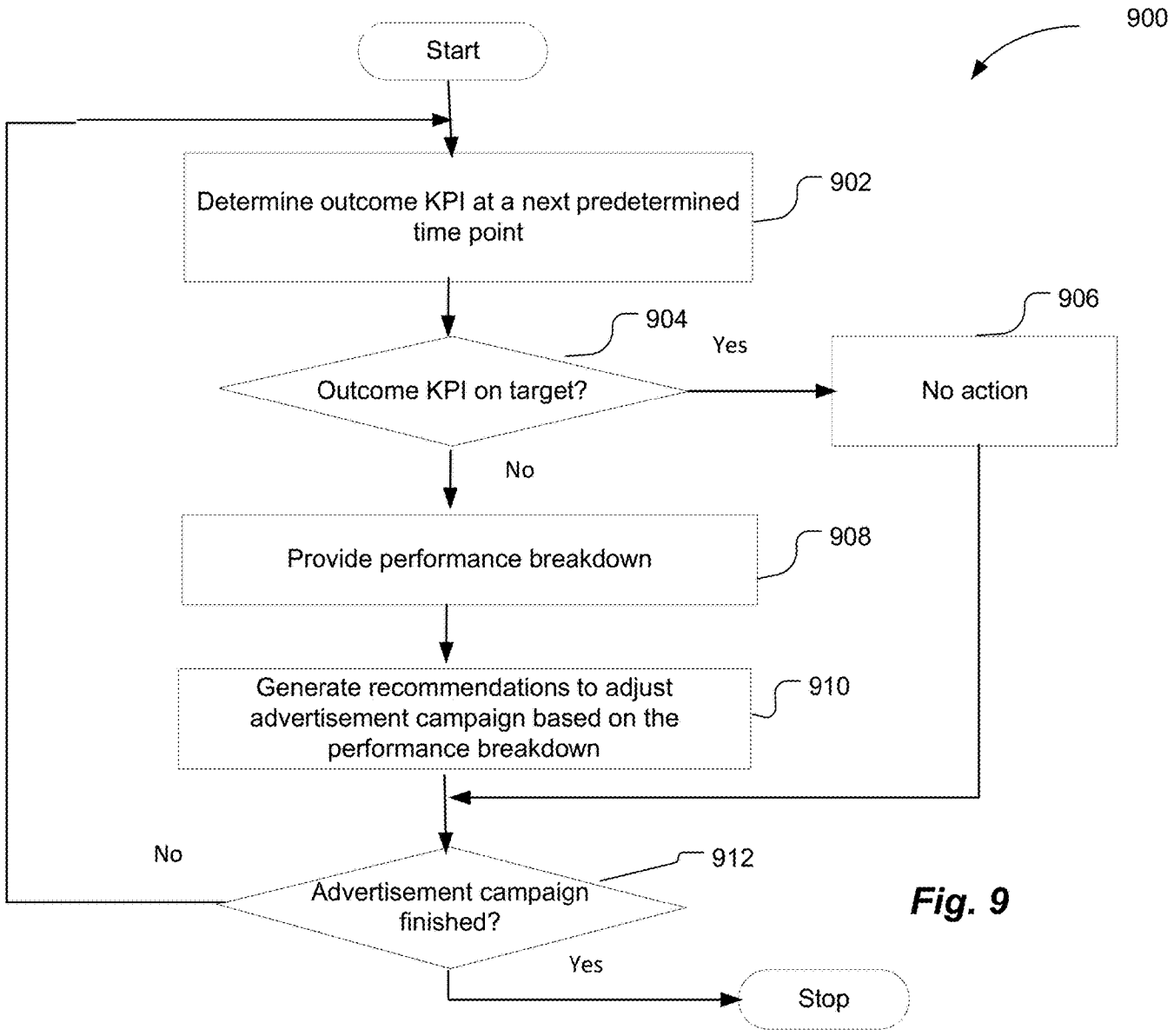
FIG. 9 is an example process flow diagram for providing recommendations based on performance of an advertisement campaign, based on COI values, in accordance with some embodiment.

FIG. 9 is an example process flow diagram for providing recommendations based on performance of an advertisement campaign, based on COI values, in accordance with some embodiment. The process 900 may be performed, for example, by COI provision engine 140 and recommendation engine 138 of FIG. 1.

The process 900 begins at block 902 and may include determining an actual outcome key performance indicator (KPI), such as a conversion rate, at a (next) predetermined time point in the advertisement campaign.

At decision block 904 it is determined whether the KPI is on target or on track to hit a predetermined target value (e.g., KPI is within a particular value range). If KPI is determined to be on target, the process 900 moves to block 906, which indicates that no action needs to be taken in regard to adjusting the advertisement campaign. The process 900 then moves to decision block 912 described below.

If at decision block 904 it is determined that the KPI is not on target (e.g., beyond a particular value range), the process 900 moves to block 908, at which performance breakdown of the advertisement campaign is provided. The campaign performance breakdown (outcome) is briefly described in reference to FIG. 7. More specifically, the campaign performance breakdown may include a real-time, up-to-date view of how the campaign's assets (e.g., advertisement spots provided by the network) are performing with relation to the actual outcome KPI. Specifically, a performance breakdown may be based on subnetworks, daypart, pod positions, and shows. In embodiments, the campaign assets may include the different varieties of advertisement spots provided by the networks (such as, for example, subnetwork, daypart, pod position, show genre, or show subgenre). For example, the network may know that primetime advertisement spots generate better outcome, while "early fringe" advertisement spots generate worse outcome. Then, if the current outcome index is not on track to hit target, the network may move some of the advertising from the "early fringe" spots to the "primetime" spots.

At block 910, recommendations to adjust advertisement campaign based on the performance breakdown may be generated.

The recommendations may be based, for example, on conversion rates and a number of impressions per conversion. For example, a campaign may be conducted concurrently by multiple networks. Based on conversion rates and a number of impressions per conversion recorded for each of the multiple networks, the recommendations may include in-flight monitoring of the campaign and shifting impressions to top performing network or networks among those conducting the campaign.

In another example, if a network delivered more impressions in one daypart versus other dayparts, but the conversion rate for this daypart was determined to be low (e.g., below a predetermined threshold), the recommendations may include moving the advertisement impressions to other dayparts.

In another example, based on the analysis of the advertisement performance (e.g., conversion rates versus number of advertisement impressions) in different subgenres of TV programs, e.g., Movies, Comedy/Variety, Documentary, Drama/Action, Reality, Sitcom, and the like, the recommendations may include moving the advertisement impressions to the subgenre(s) that are outperforming other subgenres.

In another example, if a pod position is determined to affect the conversion rate in the advertisement campaign, the recommendations may include moving the advertisement impressions to the pod or pods that are outperforming other pods.

In another example, the conversion rates determined by daypart and genre can reveal some opportunities to optimize performance, such as, for example, Weekend Day on a first network, Daytime on second network, or particular genre (e.g., Entertainment/Comedy) on a third (or first or second) network. If the highest performance is seen at daypart levels. of a network, the impressions delivery may be increased at higher levels, and the pod position may be adjusted.

In another example, particular show or shows producing relatively low conversion rates may be identified. The recommendations may include identifying these shows as "light buy" (i.e., consider moving the advertisement impressions to better performing shows). In summary, the advertisement spots differ in their "quality" (e.g. primetime spots are better than "early fringe" spots in terms of response to the campaign, such as a conversion rate for primetime spots may be higher than the one for the "early fringe" spots). Accordingly, if the network knows in advance that a campaign is not on track to deliver on its guarantee (e.g. guaranteed conversion rate), it can move the advertisement (s) to advertisement spots with higher quality. On the other hand, if a campaign is over-delivering on its guarantee, then the network can do the opposite and save the higher-quality inventory (advertisement spots) for other campaigns.

The process 900 then moves to decision block 912.

At decision block 912 it is determined whether the advertisement campaign is finished. If it is determined the campaign is finished (e.g., the time period of campaign has run out), the process 900 ends. If it is determined that the advertisement campaign is not finished, the process 900 moves back to block 902, at which KPI is determined at a next predetermined time point, and the process 900 repeats until the campaign is determined to be finished.

The conversion rate of an advertisement airing is driven not only by advertisement placement (which the network has some degree of control over), but also by the quality of the advertisement creative, such as a video or other content, which is supplied by the brand and hence the network has no control over. Thus, a purely outcome-based agreement (e.g., contract between an advertiser (brand) and a network), whether specified as an explicit guarantee on the number of conversions, or implicitly through an index-based contract, is essentially a mechanism that transfers outcome risk from the brand to the network.

Television networks are generally unwilling to absorb all the risk associated with a creative's quality, which affects the advertisement campaign's performance, and is outside of the network's control.

In embodiments, a "capped index"-based contract can control risk exposure through the addition of two contract parameters: an upper threshold ("ceiling"), which takes value ≥1, and a lower threshold ("floor"), which takes values ≤1) for the index modifier. If the COI for the advertisement campaign as described above, is larger than the value of the "ceiling", it can be set equal to the "ceiling" value. If determined COI is smaller than the value of the "floor", it can be set equal to the "floor" value. A capped index example can be denoted by:

{Y Effective Rating Points at baseline outcome KPI=Z; with ceiling=C and floor=F}, where C≥1 and F≤1.

A "symmetric" capped index-based contract can be defined as one where C=1/F, i.e., the ceiling and floor values are symmetrically defined in the multiplicative sense, as their geometric mean is equal to 1.

The ceiling and floor parameters C and F limit the upside and downside risk (respectively) from the network's perspective. Suppose C is set to the value 1. In that case, regardless of how much the ad campaign outperforms the baseline outcome, Effective Rating Points will be equal to TRPs. If floor parameter F is set to the value 1, Effective Rating Points would not be penalized below TRP regardless of how much the advertisement campaign outperforms the baseline outcome. In practice, the value of the "ceiling" C and "floor" F depends on the risk tolerance of the network, and can be determined empirically.

The capped index can be dynamically and continually updated over the course of an advertisement campaign, to allow for networks perform in-flight adjustments and optimizations.

Figure 10:
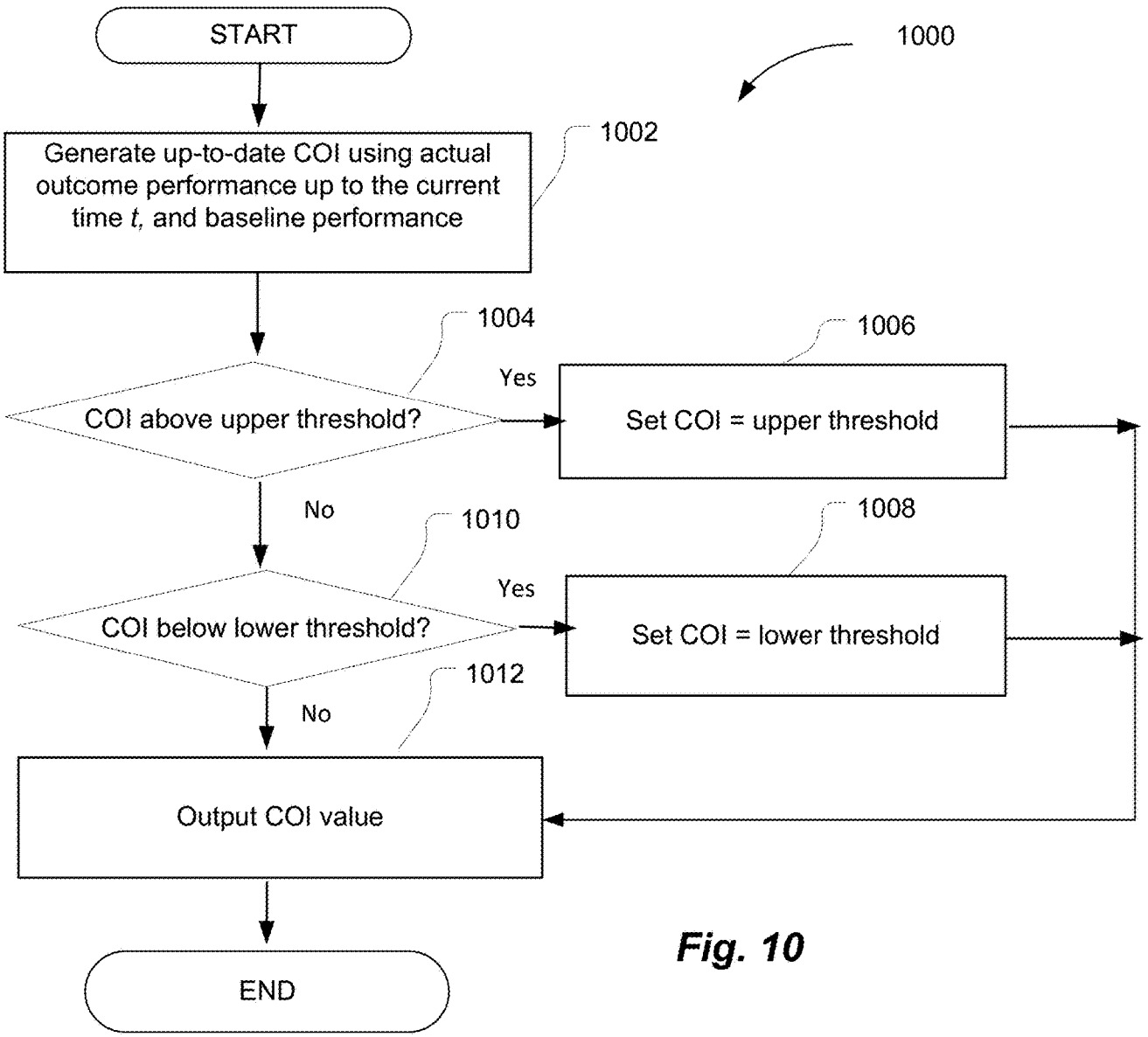
FIG. 10 is an example process flow diagram illustrating the dynamic updating of the capped index during an advertisement campaign, in accordance with some embodiments.

FIG. 10 is an example process flow diagram illustrating the dynamic updating of the capped index during an advertisement campaign, in accordance with some embodiments. The process 1000 may be performed, for example, by the COI provision engine 140 or recommendation engine 138 of FIG. 1.

The process 1000 begins at block 1002 and may include generating up-to-date COI using actual outcome performance up to the current time t, and baseline performance. It is noted that block 1002 essentially duplicates block 706 of the process 700 of FIG. 7. Accordingly, operations preceding block 706 of the process 700 may be utilized in the process 1000 in order to generate the up-to-date COI, and are not shown in the process 1000 for purposes of simplicity.

At decision block 1004, it is determined whether COI is above the upper threshold (ceiling C). If COI is determined to be above ceiling C, at block 1006 the COI value is set to the upper threshold value C. The process 1000 then moves to block 1012, where the set COI value is outputted to a user.

If at decision block 1004 COI is determined to be lower or equal to ceiling C, the process 1000 moves to decision block 1010. At decision block 1010, it is determined whether COI is below the lower threshold (floor F). If COI is determined to be below floor F, at block 1006 the COI value is set to the lower threshold value F. The process 1000 then moves to block 1012, where the set COI value is outputted to the user.

If at decision block 1010 COI is determined to be above or equal to floor F, the process 1000 moves to block 1012, where the determined COI value is outputted to the user.

The aforementioned capped index technique that may be utilized in contracts between advertisers and networks also nests a volume-only contract. In this example, both the ceiling and floor parameters are set to 1 (C=F=1). When C=F=1, the value of COI would be set to 1, hence ERP is equal to "raw TRPs". Thus, the capped index contract paradigm may be reduced to a volume-based contract where the brand and the network contract directly on raw TRPs.

Returning to the numerical example discussed above the capped index solution as described in reference to FIG. 10 will not be described in detail. Recall that the example advertising campaign as described in reference to FIGS. 2-3 and 6, is comprised of a 50-50 mix of 15 s and 30 s ads. The brand would like to purchase 10.0 Effective Rating Points at the "baseline" conversion rate of 0.314%. It is further assumed that the contract is structured as a "Capped Index contract" where a "ceiling" value of 1.15 and a "floor" value of 0.85 is put in place. Thus, in this case the contract is specified as: {10.0 Effective Rating Points, 50-50% mix of 15 s/30 s ads, at baseline conversion rate=0.314%, with ceiling=1.15, and floor=0.85}

The two example scenarios of what happens at the end of the advertisement campaign is described below.

Example 1: At the end of the advertising campaign, the network delivered 9.0 (raw) TRPs. The actual campaign-level conversion rate is 0.4%. In this case, COI=0.400/0.314=1.27. Because index is above the "ceiling" of 1.15, it is capped at 1.15. Effective Rating Points=1.15*9.0=10.35. Thus, the contract is fulfilled.

Example 2: At the end of the advertising campaign, the network delivered 11.0 (raw) TRPs. The actual campaign-level conversion rate is 0.25%. In this case, the COI=0.250/0.314=0.80. Because index is below the "floor" of 0.85, it takes the value of 0.85. Effective Rating Points=0.85*11.0=9.35. Thus, the contract is not fulfilled. The network needs to "make up" for 10.0−9.35=0.65 Effective Rating Points by airing additional ad impressions. Comparing this to the corresponding scenario described above, where the network needs to make up 1.20 Effective Rating Points, it can be seen that the downside risk that the network faces due to underperformance of the advertisement campaign is now limited.

Capped-index arrangements (e.g., agreements or contracts differ) from traditional volume-based contracts by the addition of three key parameters: the baseline outcome KPI value (Z), the ceiling parameter (C), and the floor parameter (F).

The baseline outcome KPI (Z) is the denominator in the computation of the COI (described above, where Z is a contract parameter) and should be worth more for higher value of Z. That is, if network A offers a contract at baseline conversion rate of 0.5% and network B offers a contract at baseline conversion rate of 0.3% and is otherwise the same, the advertising contract from network A should be worth more. That is, the value of a capped index arrangement (e.g., contract) is an increasing function of Z.

A natural consequence of the above relationship is that networks that tend to have high conversion rates for advertisement airings would be able to charge more for their advertisement spots, as they can offer contracts that set a higher value for baseline outcome KPI. Networks may also better differentiate their "premium" offerings by setting higher baseline outcome KPI for those offerings and hence charge a higher price. Hence, the framework of capped index contracts represents the quality of ad offerings more explicitly by quantifying the baseline outcome KPI level.

The ceiling parameter C≥1 allows networks to capture some of the "upside" if an advertising campaign outperforms its baseline performance level. As a result, a network has increased flexibility because they can substitute "quality" and "volume". As discussed earlier, the structure of a capped index arrangement means that 10 TRPs at an index value of 1.0 is equivalent to 8 TRPs at an index value of 1.25 (as 10*1.0=10=8*1.25). Thus, higher ceiling value implies higher scheduling flexibility for the network. As a result, contract value should be a decreasing function of the ceiling C.

The floor parameter F controls the extent to which outcome risk is transferred from the brand to the network. Thus, higher value of the floor parameter F limits the potential downside from the network's perspective, as the "penalty" for underperforming the baseline level becomes less severe. On the other hand, the network takes on an increasing amount of risk as the floor parameter becomes smaller. Thus, this implies that contract value should be a decreasing function of the floor parameter F.

When both the ceiling and floor parameters equal 1, the capped-index arrangement reduces to the volume-only contract, where the brand and network are only contracting based on raw TRPs. As a result, the pricing of a capped index arrangement should converge to the value of a volume-based contract when both C and F approaches 1.

Accordingly, the following principles and guidelines for the pricing of capped index contracts as a function of baseline outcome level Z, ceiling parameter C, and floor parameter F are offered herein, At C=F=1, a capped index contract reduces to a volume-based contract; hence the value of a capped index contract converges to volume-based contract as C and F approach 1. The value of a capped index contract is an increasing function of the baseline outcome level Z. The value of a capped index contract is a decreasing function of the ceiling parameter C. The value of a capped index contract is a decreasing function of the floor parameter F.

Figure 11:
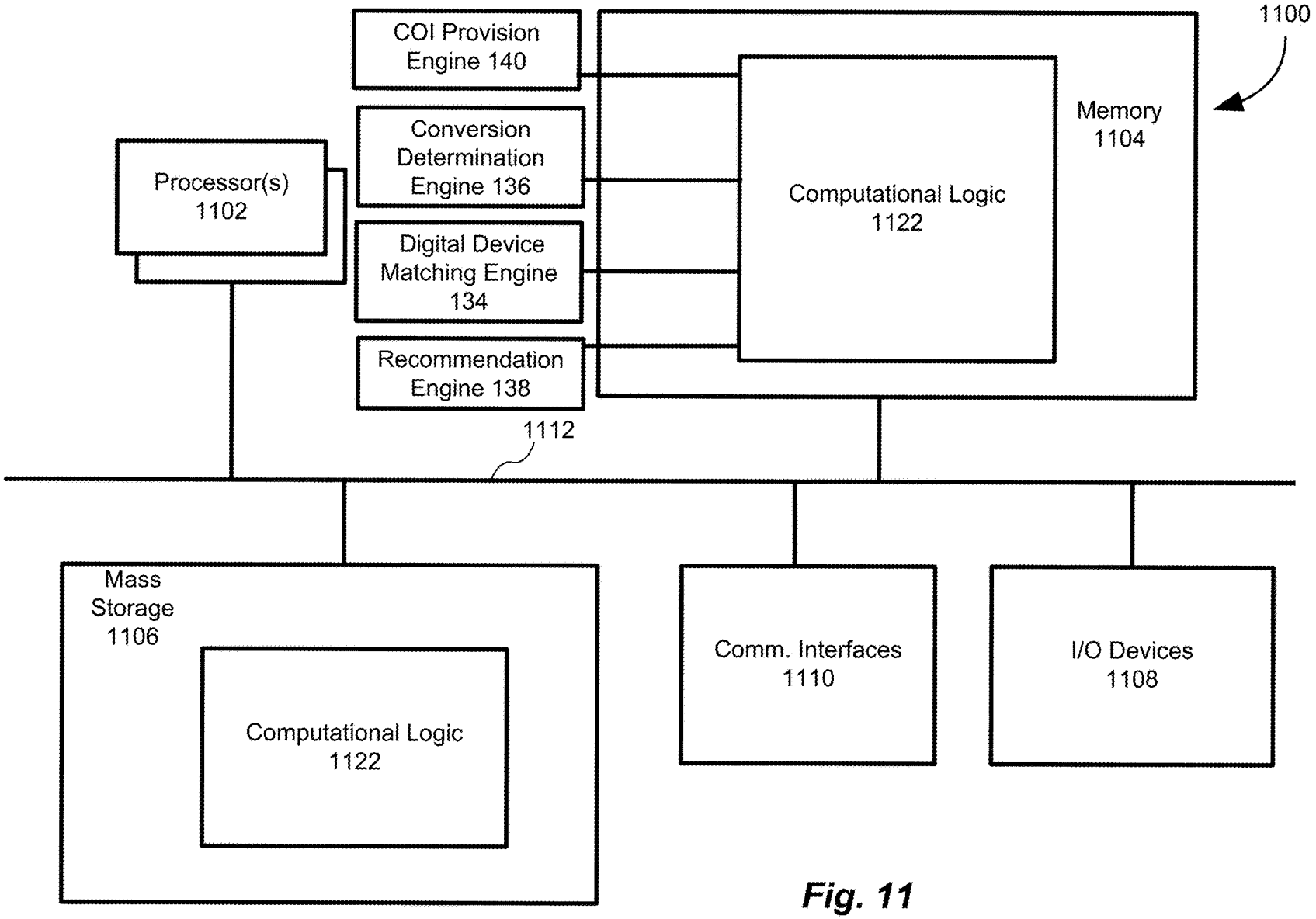
FIG. 11 illustrates an example computing device suitable for use to practice aspects of the present disclosure, in accordance with some embodiments.

FIG. 11 illustrates an example computing device suitable for use to practice aspects of the present disclosure, in accordance with some embodiments. For example, the example computing device 1100 may be suitable to implement the functionalities of the computing device 124.

As shown, computing device 1100 may include one or more processors or processor cores 1102, and system memory 1104. For the purpose of this application, including the claims, the term "processor" refers to a physical processor, and the terms "processor" and "processor cores" may be considered synonymous, unless the context clearly requires otherwise. The processor 1102 may include any type of processors, such as a central processing unit (CPU), a microprocessor, and the like. The processor 1102 may be implemented as an integrated circuit having multi-cores, e.g., a multi-core microprocessor. The computing device 1100 may include mass storage devices 1106 (such as diskette, hard drive, volatile memory (e.g., dynamic random access memory (DRAM)), compact disc read only memory (CD-ROM), digital versatile disk (DVD) and so forth). In general, system memory 1104 and/or mass storage devices 1106 may be temporal and/or persistent storage of any type, including, but not limited to, volatile and non-volatile memory, optical, magnetic, and/or solid state mass storage, and so forth. Volatile memory may include, but not be limited to, static and/or dynamic random access memory. Non-volatile memory may include, but not be limited to, electrically erasable programmable read only memory, phase change memory, resistive memory, and so forth.

The computing device 1100 may further include input/output (I/O) devices 1108 such as a display, keyboard, cursor control, remote control, gaming controller, image capture device, and so forth and communication interfaces 1110 (such as network interface cards, modems, infrared receivers, radio receivers (e.g., Bluetooth), and so forth). I/O devices 1108 may be suitable for communicative connections with user digital device 102 or TV set 104, as well as content provider computer 112.

The communication interfaces 1110 may include communication chips (not shown) that may be configured to operate the device 1100 (or 124) in accordance with a Global System for Mobile Communication (GSM), General Packet Radio Service (GPRS), Universal Mobile Telecommunications System (UMTS), High Speed Packet Access (HSPA), Evolved HSPA (E-HSPA), or Long Term Evolution (LTE) network. The communication chips may also be configured to operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chips may be configured to operate in accordance with Code Division Multiple Access (CDMA), Time Division Multiple Access (TDMA), Digital Enhanced Cordless Telecommunications (DECT), Evolution-Data Optimized (EV-DO), derivatives thereof, as well as any other wireless protocols that are designated as 3G, 4G, 5G, and beyond. The communication interfaces 1110 may operate in accordance with other wireless protocols in other embodiments.

The above-described computing device 1100 elements may be coupled to each other via system bus 1112, which may represent one or more buses. In the case of multiple buses, they may be bridged by one or more bus bridges (not shown). Each of these elements may perform its conventional functions known in the art. In particular, system memory 604 and mass storage devices 1106 may be employed to store a working copy and a permanent copy of the programming instructions implementing the operations associated with apparatus 124, e.g., operations associated with providing digital device matching engine 134, conversion determination engine 136, COI provision engine 140, or recommendation engine 138 as described in reference to FIG. 1, generally shown as computational logic 1122. Computational logic 1122 may be implemented by assembler instructions supported by processor(s) 1102 or high-level languages that may be compiled into such instructions.

The permanent copy of the programming instructions may be placed into mass storage devices 1106 in the factory, or in the field, through, for example, a distribution medium (not shown), such as a compact disc (CD), or through communication interfaces 1110 (from a distribution server (not shown)).

Figure 12:
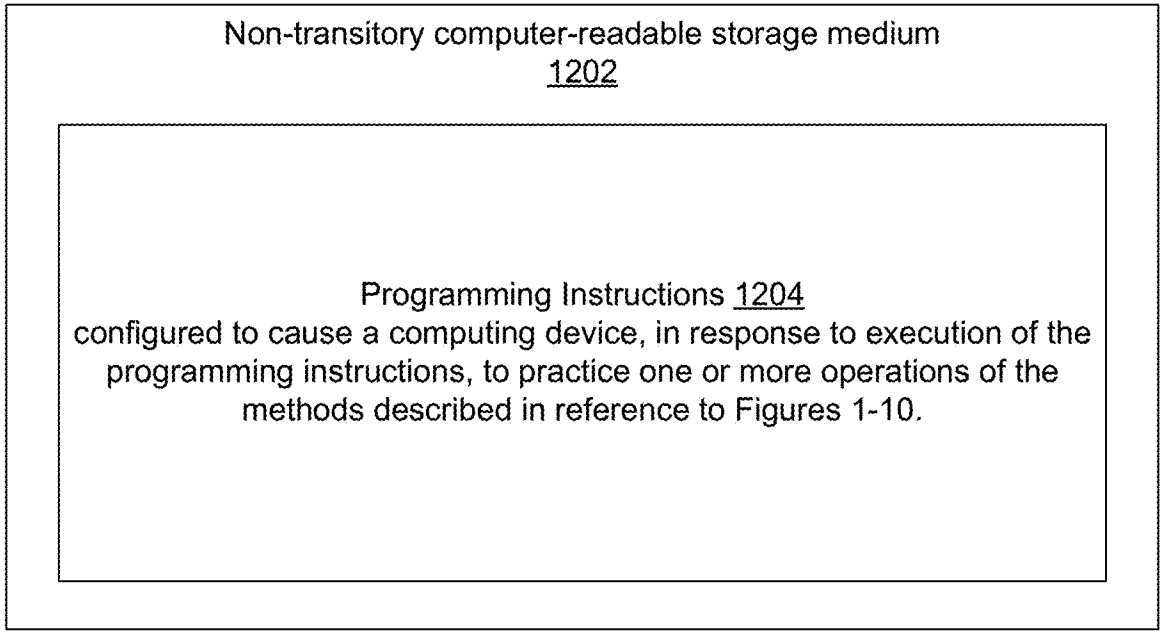
FIG. 12 illustrates an example non-transitory computer-readable storage medium having instructions configured to practice all or selected ones of the operations associated with the processes described in reference to FIGS. 1-10, in accordance with some embodiments.

FIG. 12 illustrates an example non-transitory computer-readable storage medium having instructions configured to practice all or selected ones of the operations associated with the processes described in reference to FIGS. 1-10, in accordance with some embodiments. As illustrated, non-transitory computer-readable storage medium 1202 may include a number of programming instructions 1204 (e.g., including engines 134, 136, 140, and 138). Programming instructions 1204 may be configured to enable a device, e.g., computing device 1100, in response to execution of the programming instructions, to perform one or more operations of the processes described in reference to FIGS. 1-10. In alternate embodiments, programming instructions 1204 may be disposed on multiple non-transitory computer-readable storage media 1202 instead. In still other embodiments, programming instructions 1204 may be encoded in transitory computer-readable signals.

Referring again to FIG. 11, the number, capability, and/or capacity of the elements 1108, 1110, 1112 may vary, depending on whether computing device 1100 is used to implement the computing device 124, whether computing device 1100 is a stationary computing device, such as a set-top box or desktop computer, or a mobile computing device, such as a tablet computing device, laptop computer, or smartphone. Their constitutions are otherwise known, and accordingly will not be further described.

In various implementations, the computing device 1100 when used to implement computing device 124 may comprise a stand-alone server or a server of a computing rack or cluster. In further implementations, the computing device 1100 may be any other electronic device that processes data.

Computer-readable media (including non-transitory computer-readable media), methods, apparatuses, systems, and devices for performing the above-described techniques are illustrative examples of embodiments disclosed herein. Additionally, other devices in the above-described interactions may be configured to perform various disclosed techniques.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims.

What is claimed is:

1. An apparatus to provide recommendations for an advertisement campaign, comprising:

one or more processors;

a campaign outcome index provision engine communicatively coupled to the one or more processors, to generate a campaign outcome index (COI) associated with the advertisement campaign, based at least in part on a ratio between an actual outcome key performance indicator (KPI) associated with the advertisement campaign, and a baseline outcome KPI that reflects an expected average performance of the advertisement campaign, wherein the campaign outcome provision engine is to:

generate the baseline outcome KPI, which includes to:

obtain historical benchmark data on a performance of the advertisement campaign;

estimate a quantile regression model based on the historical benchmark data; and determine the baseline outcome KPI based at least in part on the quantile regression model;

generate the actual outcome KPI, based at least in part on a calculation of a contribution of an advertisement of the advertisement campaign to a conversion rate; and output the COI, based at least in part on the baseline outcome KPI and the actual outcome KPI, wherein the COI is to be used to compute Effective Rating Points (ERP) of the advertisement campaign, wherein the ERP equals a Target Rating Points (TRP) multiplied by the COI, wherein the TRP is a volume-based metric of the advertisement campaign, wherein the ERP is used to provide an outcome-based characteristics of the advertisement campaign; and a recommendation engine, communicatively coupled to the one or more processors, to provide recommendations to adjust a use of advertisements in the advertisement campaign, during the advertisement campaign, based at least in part on the generated COI.

2. The apparatus of claim 1, wherein the actual outcome KPI and baseline outcome KPI comprise respective conversion rates or other performance-reflecting parameters associated with the advertisement campaign, wherein a conversion rate is a performance-reflecting parameter that indicates one or more user actions performed in response to viewing one or more advertisements associated with the advertisement campaign.

3. The apparatus of claim 1, wherein the campaign outcome provision engine is further to generate performance characteristics associated with the advertisement campaign, wherein the recommendation engine is to provide recommendations that are further based in part on the generated performance characteristics.

4. The apparatus of claim 3, wherein the performance characteristics include one or more of: subnetworks, daypart, pod positions, or programs in which the advertisement campaign is conducted.

5. The apparatus of claim 1, further comprising:

a digital device matching engine, communicatively coupled to the one or more processors, to receive and process information obtained from a web site accessed by a digital device, and to match the digital device to a television (TV) set, based at least in part on the processed information; and a conversion determination engine, communicatively coupled to the one or more processors, to determine a conversion rate associated with an advertisement rendered by a broadcasting media to the TV set, based at least in part on a matching of the digital device to the TV set.

6. The apparatus of claim 5, wherein the processed information comprises one or more user identity indicators that include at least one of:

date and time of access of a web site by the user to perform one or more actions in response to viewing one or more advertisements associated with the advertisement campaign;

an internet protocol (IP) address associated with the user; a web site identifier;

a user identifier (ID) associated with the web site;

a type of a conversion action associated with the user, including one or more of: a web site visit, add to cart, or checkout; a uniform resource locator (URL) associated with the web site;

a type of a browser associated with access to the web site;

a type of the digital device;

an operating system (OS) associated with the digital device; tracking cookies; or one or more tags for reporting or filtering.

7. The apparatus of claim 6, wherein the digital device matching engine is to determine web traffic associated with the digital device.

8. The apparatus of claim 7, wherein the digital device matching engine is to identify an internet protocol (IP) address of the digital device that was used by the digital device over a determined time period, based at least in part on the web traffic.

9. The apparatus of claim 8, wherein the digital device matching engine is to match the digital device to the TV set, further based at least in part on comparing a history of use of the IP address of the digital device and an IP address of the TV set.

10. The apparatus of claim 6, wherein the one or more user actions include one or more of: accessing the web, viewing information about an item described in the advertisement, selecting the viewed item, adding the selected item to cart, or checking out the selected items.

11. One or more computer-readable media having instructions for providing recommendations for an advertisement campaign stored thereon that, in response to execution by a computing device, cause the computing device to:

generate a campaign outcome index (COI) associated with the advertisement campaign, based at least in part on a ratio between an actual outcome key performance indicator (KPI) associated with the advertisement campaign, and a baseline outcome KPI that reflects an expected average performance of the advertisement campaign, wherein the computing device is to:

generate the baseline outcome KPI, which includes to:

obtain historical benchmark data on a performance of the advertisement campaign;

estimate a quantile regression model based on the historical benchmark data; and determine the baseline outcome KPI based at least in part on the quantile regression model;

generate the actual outcome KPI, based at least in part on a calculation of a contribution of an advertisement of the advertisement campaign to a conversion rate;

output the COI, based at least in part on the baseline outcome KPI and the actual outcome KPI, wherein the COI is to be used to compute Effective Rating Points (ERP) of the advertisement campaign, wherein the ERP equals a Target Rating Points (TRP) multiplied by the COI, wherein the TRP is a volume-based metric of the advertisement campaign, wherein the ERP is used to provide an outcome-based characteristics of the advertisement campaign; and provide recommendations to adjust a use of advertisements in the advertisement campaign, during the advertisement campaign, based at least in part on the generated COI.

12. The computer-readable media of claim 10, wherein the actual outcome KPI and baseline outcome KPI comprise respective conversion rates or other performance-reflecting parameters associated with the advertisement campaign, wherein a conversion rate is a performance-reflecting parameter that indicates one or more user actions performed in response to viewing one or more advertisements associated with the advertisement campaign.

13. The computer-readable media of claim 10, wherein the instructions further cause the computing device to generate performance characteristics associated with the advertisement campaign, wherein the instructions that cause the computing device to provide recommendations are further based in part on the generated performance characteristics.

14. The computer-readable media of claim 10, wherein the instructions further cause the computing device to:

receive and process information obtained from a web site accessed by a digital device, and to match the digital device to a television (TV) set, based at least in part on the processed information; and determine the conversion rate associated with an advertisement rendered by a broadcasting media to the TV set, based at least in part on a matching of the digital device to the TV set.

15. A computer-implemented method for providing recommendations for an advertisement campaign, comprising:

generating, by a computing device, a campaign outcome index (COI) associated with the advertisement campaign, based at least in part on a ratio between an actual outcome key performance indicator (KPI) associated with the advertisement campaign, and a baseline outcome KPI that reflects an expected average performance of the advertisement campaign, including: generating, by the computing device, the baseline outcome KPI, which includes:

obtaining historical benchmark data on a performance of the advertisement campaign;

estimating a quantile regression model based on the historical benchmark data; and determining the baseline outcome KPI based at least in part on the quantile regression model;

generating, by the computing device, the actual outcome KPI, based at least in part on a calculation of a contribution of an advertisement of the advertisement campaign to a conversion rate; and outputting, by the computing device, the COI, based at least in part on the baseline outcome KPI and the actual outcome KPI, wherein the COI is to be used to compute Effective Rating Points (ERP) of the advertisement campaign, wherein the ERP equals a Target Rating Points (TRP) multiplied by the COI, wherein the TRP is a volume-based metric of the advertisement campaign, wherein the ERP is used to provide an outcome-based characteristics of the advertisement campaign; and providing recommendations, by the computing device, to adjust a use of advertisements in the advertisement campaign, during the advertisement campaign, based at least in part on the generated COI.

16. The computer-implemented method of claim 15, wherein the actual outcome KPI and baseline outcome KPI comprise respective conversion rates or other performance-reflecting parameters associated with the advertisement campaign, wherein a conversion rate is a performance-reflecting parameter that indicates one or more user actions performed in response to viewing one or more advertisements associated with the advertisement campaign.

17. The computer-implemented method of claim 15, further comprising:

generating, by the computing device, performance characteristics associated with the advertisement campaign, wherein providing the recommendations is further based in part on the generated performance characteristics.

* * * * *